United States Patent [19]

Ueda et al.

[11] 4,157,917

[45] Jun. 12, 1979

[54] COLOR PHOTOGRAPHIC LIGHT-SENSITIVE MATERIAL

[75] Inventors: Hirozo Ueda; Yasuo Aotsuka, both of Minami-ashigara, Japan

[73] Assignee: Fuji Photo Film Co., Ltd., Minami-ashigara, Japan

[21] Appl. No.: 523,083

[22] Filed: Nov. 12, 1974

[30] Foreign Application Priority Data

Nov. 12, 1973 [JP] Japan ..... 48/127084

[51] Int. Cl.[2] ..... G03C 1/76; G03C 3/00; G03C 1/84

[52] U.S. Cl. ..... 96/69; 96/84 R; 96/68; 96/74

[58] Field of Search ..... 96/69, 68, 84 R, 74

[56] References Cited

U.S. PATENT DOCUMENTS

| | | | |
|---|---|---|---|
| 2,697,036 | 12/1954 | Higgins et al. | 96/69 |
| 2,697,037 | 12/1954 | Jelly et al. | 96/69 |
| 3,658,536 | 4/1972 | Wolf | 96/69 |
| 3,663,228 | 5/1972 | Wyckoff | 96/74 |

*Primary Examiner*—Travis Brown
*Assistant Examiner*—L. Falasco
*Attorney, Agent, or Firm*—Sughrue, Rothwell, Mion, Zinn and Macpeak

[57] ABSTRACT

A color photographic light-sensitive material which comprises a support having thereon at least a red-sensitive silver halide emulsion layer, a green-sensitive silver halide emulsion layer, a yellow filter layer and a blue-sensitive silver halide layer, in which the green-sensitive layer comprises a first green-sensitive silver halide emulsion layer and a second green sensitive silver halide emulsion layer and the relative positionwise relationship of each layer is in the order of the red-sensitive silver halide emulsion layer, the first green-sensitive silver halide emulsion layer, the yellow filter layer, the blue-sensitive silver halide emulsion layer and the second green-sensitive silver halide emulsion layer from the support.

18 Claims, 5 Drawing Figures

COLOR PHOTOGRAPHIC LIGHT-SENSITIVE MATERIAL

BACKGROUND OF THE INVENTION

1. Field of the Invention

The present invention relates to a highly sensitive color light-sensitive material for use in photography having improved image sharpness.

2. Description of the Prior Art

In color photographic materials, color images which spread or blotted color images must not be formed, distinct images with fine detail, i.e., sharpness, must be obtained and the color particles forming color images must be fine enough that one does not notice that the images are composed of particles.

The sharpness or graininess is determined by the following factors:

(1) the particle size distribution of silver halide crystals and the state of the dispersion of the silver halide crystals in an emulsion;

(2) optical properties such as scattering and reflection of light of various wavelengths upon exposure;

(3) chemical properties such as developing speed, developing effect, etc.; and (4) others.

Therefore, in order to improve the graininess and/or sharpness, effective countermeasures for at least one of the above-described factors (1) to (4) must be taken and in this respect various suggestions have been made.

Color light-sensitive materials for use in photography comprise at least a yellow-coloring layer, a yellow filter layer, a magenta-coloring layer and a cyan-coloring layer. In order to permit only light which is in a complementary relation with the color image to reach each layer, color light-sensitive materials usually possess a stratum structure in which the cyan-coloring red-sensitive silver halide emulsion layer, the magenta-coloring green-sensitive silver halide emulsion layer, the yellow filter layer and the yellow-coloring blue-sensitive silver halide emulsion layer are arranged in this sequence from the support.

It is empirically known that the visual (or apparent) sharpness of images formed in color light-sensitive materials is most influenced by the sharpness of the magenta image and next most influenced by the sharpness of the cyan image. However, in the conventional stratum structure, the sharpness of the magenta image has been poor since the green-sensitive layer is influenced by light-scattering in the blue-sensitive layer, resulting in the formation of images having apparently poor sharpness. It is true that this problem would be solved by positioning the magenta-coloring layer as the uppermost layer to form a stratum structure in the order of the blue-sensitive layer, the red-sensitive layer, the green-sensitive layer and the yellow filter from the support side, but a serious defect is involved with this layer disposition. That is, since blue light is absorbed by the yellow filter layer, the green-sensitive layer and the red-sensitive layer, the amount of blue light reaching the blue-sensitive layer which possesses a spectral sensitivity for blue light and essentially necessitates blue light is seriously reduced. In other words, the effective sensitivity of the blue-sensitive layer becomes far less (i.e., 1/100–1/1000) than the essential sensitivity of the emulsion. In order to adjust the color balance, the sensitivities of other layers are reduced and, as a result, the sensitivity of the entire light-sensitive material becomes extremely low. Further, when tungsten light is used as a light source, the sensitivities of the red-sensitive layer and the green-sensitive layer must be reduced to lower than that of the blue-sensitive layer in order to adjust the color balance, since the light source itself contains less blue light component and more red light component. Therefore, it has actually been impossible to form a stratum structure of a highly sensitive color light-sensitive material for photography using the above-described latter sequence. In order to remove this defect, U.S. Pat. No. 3,658,536 discloses a stratum structural configuration in which only part of the blue-sensitive layer is provided under the green-sensitive or red-sensitive layer and the rest is allowed to remain at the uppermost side, thus obtaining the effective sensitivity of the blue-sensitive layer and reducing the influence of light scattering on the green-sensitive layer to improve the sharpness with a high sensitivity being maintained.

SUMMARY OF THE INVENTION

Therefore, an object of the present invention is to provide a highly sensitive color light-sensitive material for use in photographing having a novel stratum structure.

Another object of the present invention is to provide a highly sensitive color light-sensitive material for use in photography providing improved sharpness.

A further object of the present invention is to provide a highly sensitive color light-sensitive material for use in photography having improved graininess.

Still a further object of the present invention is to provide a light-sensitive material in which both the sharpness and graininess are improved at the same time.

The above-described objects of the present invention can be attained by forming the stratum structure of a color light-sensitive material for use in photography comprising a support having thereon at least a red-sensitive silver halide emulsion layer, a green-sensitive silver halide emulsion layer, a blue-sensitive silver halide emulsion layer and a yellow filter, so that a part of the green-sensitive silver halide emulsion layer is positioned on the blue-sensitive silver halide emulsion layer.

In the figures, 1 designates a support, 2 a yellow filter layer, 3 a yellow filter layer having reduced density, 4 a protective layer, 5 a protective layer partly sharing the density of a yellow filter layer, provided that, with respect to the yellow density, the yellow density of 3 plus the yellow density of 5 equals the yellow density of 2, G a green-sensitive layer, $G_1$ one of two separated green-sensitive layers which is nearer the support, $G_2$ the other of the two green-sensitive layers which is farther from the support, R a red-sensitive layer, $R_1$ one of two separated red-sensitive layers which is nearer the support, $R_2$ the other of the two red-sensitive layers which is farther from the support and B a blue-sensitive layer.

DETAILED DESCRIPTION OF THE INVENTION

The invention will be explained in greater detail by reference to the accompanying drawings.

Figure 1:
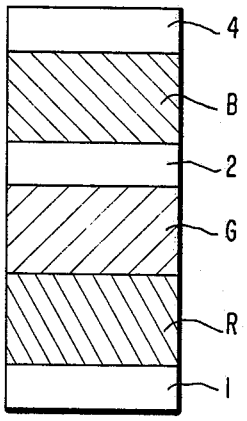
FIG. 1 shows a schematic view of the stratum structure of conventionally known color photographic light-sensitive materials for use in photography, in which only the layers necessary for the explanation of the present invention are shown.

FIG. 1 shows a stratum structure of conventional color light-sensitive materials comprising a support having thereon, in sequence, a red-sensitive silver halide emulsion layer (RL), a green-sensitive silver halide emulsion layer (GL), a yellow filter (YF), a blue-sensitive silver halide emulsion layer (BL) and a protective layer (PC) at the uppermost side, with respect to incident light on exposure.

Figure 2:
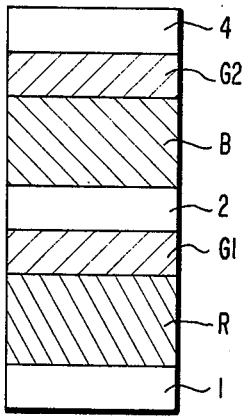
FIGS. 2, 3, 4 and 5 show schematic views of the stratum configuration of embodiments of the color photographic light-sensitive materials of the present invention for use in photography, in which only the layers necessary for the explanation of the present invention are shown.

FIG. 2 shows a fundamental embodiment of the present invention, in which the GL is separated into two layers and one of them is positioned as a second green-sensitive silver halide emulsion layer ($G_2L$) between the BL and the PC.

Figure 3:
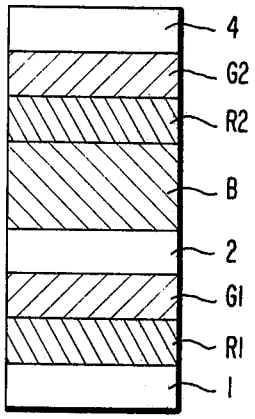

FIG. 3 shows another embodiment of the present invention, in which the RL as well as the GL is separated into two layers and one of the layers is positioned as a second red-sensitive silver halide emulsion layer ($R_2L$) on the BL and under the $G_2L$ in the direction of incident light on exposure.

Figure 4:
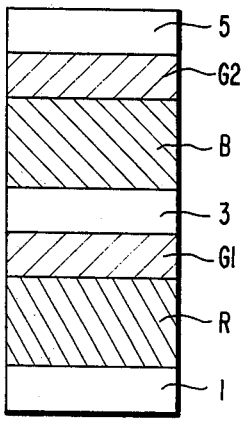
Figure 5:
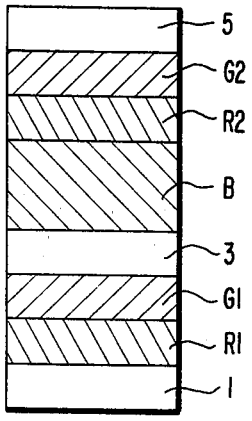

FIGS. 4 and 5 show modifications of embodiments shown in FIGS. 2 and 3, respectively, in which also the yellow filter layer is separated into two portions and the yellow filter density corresponding to one of the layers is shared by the protective layer.

Additionally, FIGS. 1 to 5 show only the layers necessary for explaining the present invention. In practicing the present invention, other layers such as a subbing layer, an anti-halation layer, an inter-layer, and the like can be employed as the occasion demands.

The second green-sensitive layer positioned on the blue-sensitive layer can exert the effect of the present invention as long as the magenta dye density obtained, upon color development of the emulsion, by the magenta coupler contained therein is not substantially zero. However, the layer preferably contains the magenta coupler in an amount sufficient to provide about $\frac{1}{4}$ to $\frac{3}{4}$ the total magenta dye density obtained by color development of the light-sensitive material in accordance with the present invention (and the corresponding amount of silver halide).

The thickness of the second green-sensitive layer is not particularly limited as long as a suitable magenta dye density can be obtained upon color development. However, the thinner the thickness is, the better.

The yellow density for the yellow filter which can be shared by the protective layer is preferably not more than about 50% of the total yellow filter density.

When a part of the green-sensitive layer is positioned as the uppermost layer, the sharpness in the green-sensitive layer and, therefore, the sharpness of the overall color light-sensitive material are markedly improved since the influence of light-scattering in the blue-sensitive layer is removed. Furthermore, since only a part of the green-sensitive layer is positioned on the blue-sensitive layer, no reduction in density occurs in contrast to the above-described case where the blue-sensitive layer is positioned nearest the support.

Where no yellow filter is positioned on the green-sensitive layer, this might appear inconvenient since the green-sensitive layer is sensitive to blue light as well. However, when the green-sensitive layer is located at the uppermost position, it is possible, to reduce the intrinsic sensitivity of the emulsion without deteriorating the color balance of the light-sensitive material. Therefore, even when the layer provides a magenta color upon exposure to blue light, the layer does not seriously influence the color balance. Further, since a part of the yellow density of the yellow filter can be shared by the protective layer as is shown in FIG. 4, no problem occurs. The filter density of the protective layer on the blue-sensitive layer is so small that any reduction in sensitivity of the blue-sensitive layer is small as well.

As is described above, the sensitivity of the green-sensitive layer provided at the uppermost side is not necessarily the same as that of the green-sensitive layer provided at a lower position. The sensitivity is determined according to the requirement for well-balancing the overall color balance of the stratum structure. In general, as has been described before, the second green-sensitive layer can have a low sensitivity as compared with the green-sensitive layer of ordinary photographic color light-sensitive materials. As a result, fine-grained silver halide can be used, which improves the graininess of the overall light-sensitive material. The degree of low sensitivity is difficult to specify in a general manner because the sensitivity depends upon the photographic sensitivity of the overall light-sensitive material, the stratum structure, the halogen composition of the silver halide and the kind and the amount of additives in the emulsions including color couplers. For example, however, the sensitivity of the second green-sensitive layer can be about 0.1 to 0.2 times the sensitivity of the first green-sensitive layer. Further, the silver halide grain size for the first green-sensitive layer can, for example, range from about 0.5 to 3 microns and for the second green-sensitive layer from about 0.15 to 1 micron.

Additionally, the red-sensitive layer as well as the green-sensitive layer can be separated into two layers, one of the layers being positioned as a second red-sensitive layer on the blue-sensitive layer and under the second green-sensitive layer, for example, as described in U.S. patent application Ser. No. 523,176, filed Nov. 12, 1974 (corresponding to Japanese Patent Application No. 127083/1973). Because, the degree to which the red-sensitive layer influences the sharpness is next to that of the green-sensitive layer, this second red-sensitive layer to be positioned on the blue-sensitive layer preferably provides about $\frac{1}{4}$ to $\frac{3}{4}$ the total cyan dye density formed, for the same reason as described before.

Additionally, when the green-sensitive layer or part of both the green-sensitive layer and the red-sensitive layer is positioned on the yellow filter layer, the following good results can be obtained in addition to the improvement of sharpness. That is, when the color balance is adjusted so that the light-sensitive material is suited for photographing using light from a tungsten light source, the deterioration of color balance when photographing is conducted under light from a fluorescent lamp or under a mixture of light from a fluorescent lamp and a tungsten lamp is greatly reduced.

It can easily by understood that, since the gist of the present invention lies is positioning part of the green-sensitive layer or, further, part of the red-sensitive layer on the blue-sensitive layer, photographic emulsions, additives, etc. suitable for each layer of the light-sensitive material of the present invention include those compositions and compounds (materials) which are suitable for ordinary photographic color light-sensitive materials.

According to the present invention, optical factors such as scattering and reflection of light upon exposure are removed to improve sharpness. As a result, the particle size distribution and the dispersion state of the silver halide crystals in an emulsion are improved, thus graininess being improved as well.

Some examples of suitable additives are illustrated below. For example, well known antifogging agents and an stabilizing agents, including 4-hydroxy-6-methyl-1,3,3*a*,7-tetrazaindene can be employed. Additional examples are shown in C. E. K. Mees and T. H. James; *The Theory of the Photographic Process,* 3rd. Ed., p. 344 Macmillan, (1966), and the original literature references cited therein and in the following patents: U.S. Pat. Nos. 1,758,576, 2,110,178, 2,131,038, 2,173,628, 2,697,040, 2,304,962, 2,324,123, 2,394,198, 2,444,605~8, 2,566,245, 2,694,716, 2,697,099, 2,708,162, 2,728,663~5, 2,746,536, 2,824,001, 2,343,491, 2,886,473, 3,052,544, 3,137,577, 3,220,839, 3,226,231, 3,236,652, 3,251,691, 3,252,799, 3,287,135, 3,326,681, 3,420,668, 3,622,339, British Patent Publication Nos. 893,428, 403,789, 1,173,609, 1,220,188.

Suitable examples of chemical sensitizing agents are described in U.S. Pat. Nos. 2,399,083, 2,540,085, 2,597,856, 2,597,915, 2,566,263, 2,598,079, 2,448,060, 2,540,086, 2,566,245, 3,501,313, 1,574,944, 2,410,689, 3,189,458, 2,487,850, 2,518,698, 2,521,925, 2,521,926, 2,694,637, 2,983,610, 3,201,254, etc.

Also, surface active agents can be used alone or in combination. They are used as a coating aid and, in some cases, used for other purposes such as for emulsion dispersion, sensitization, antistatic purposes, adhesion-preventing purposes, etc. Suitable surface active agents, including a large number of known compounds including natural surface active agents such as saponin used for photographic purposes. Examples of other suitable surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, German Patent OLS No. 1,942,665, British Patent Publication Nos. 1,077,317, 1,198,450, etc.

Similarly, an extremely large number of color couplers is known, too. In the present invention, addition of couplers to an emulsion can be effected either by dissolving in an oil for dispersion or by adding couplers in the form of an alkaline aqueous solution.

For example, suitable couplers for the blue-sensitive layer are those described in U.S. Pat. Nos. 2,875,057, 3,265,506, 3,551,155, 3,551,156, 3,558,319, U.S. patent application Ser. No. 235,937, filed Nov. 20, 1973, Japanese Patent Publication No. 5582/67, Japanese Patent Laid-Open No. 66836/73, etc. and suitable couplers for the green-sensitive layer are those described in U.S. Pat. Nos. 2,600,788, 2,983,608, 3,062,653, 3,476,560, British Patent No. 956,261, Japanese Patent Laid-Open No. 26133/72, etc. Also, suitable couplers for the red-sensitive layer are those described in U.S. Pat. Nos. 2,474,293, 2,698,794, 3,034,892, 3,481,714, 3,581,971, 3,591,383, etc. In addition, the DIR compounds described in U.S. Pat. Nos. 3,227,554, 3,253,924, 3,297,445, 3,311,476, 3,379,529, 3,516,831, 3,617,291, 3,705,801, German Patent OLS No. 2,163,811, etc. can also be used. The green-sensitive layer and red-sensitive layer can be spectrally sensitized or supersensitized by the individual or combined use of polymethine dyes (e.g., cyanine, merocyanine, carbocyanine or like cyanine dyes, as disclosed in C. E. K. Mees & T. H. James, supra Revised Ed. Macmillan, or F. M. Hamer; *The Chemistry of Heterocyclic Compounds: The Cyanine Dyes and Related Compounds,* Interscience Publishers; (those having a sulfo group or a carboxy group as a N-substituent being preferred), or by the combination thereof with a styryl dye, etc. Furthermore, in order to improve heat desensitization property or increase the intrinsic sensitivity of the blue-sensitive layer, a cyanine dye can be added to the blue-sensitive layer.

These color-sensitizing agents are well known, and typical examples thereof are described in, e.g., U.S. Pat. Nos. 2,493,748, 2,519,001, 2,977,229, 3,480,434, 3,672,897, 2,688,545, 2,912,329, 3,397,060, 3,511,664, 3,522,052, 3,527,641, 3,615,613, 3,615,632, 3,615,635, 3,617,295, 3,628,964, 3,635,721, British Pat. Nos. 1,137,580, 1,195,302, 1,216,203, 1,242,588, 1,293,862, West German Patent OLS Nos. 2,030,326, 2,122,780, Japanese Patent Publication Nos. 4936/68, 14030/69, 10773/68, etc. These can be properly selected according to the wavelength region to be sensitized, sensitivity, purpose and end use of the light-sensitive materials.

The binder for the silver halide is a hydrophilic colloid, and illustrative examples thereof are, e.g., proteins such as gelatin, colloidal albumin, casein, etc.; cellulose derivatives such as carboxymethyl cellulose, hydroxyethyl cellulose, etc.; polysaccharides such as agar-agar, sodium alginate, starch compounds, etc.; synthetic hydrophilic colloids such as polyvinyl alcohol, poly-N-vinylpyrrolidone, polyacrylic acid copolymers, polyacrylamide or the derivatives or partially hydrolyzed products thereof; and the like. If desired, a compatible mixture of two or more of them can be used. Of these, gelatin is used most generally. However, gelatin can be replaced, partly or completely, by a synthetic high molecular weight substance, by a so-called gelatin derivative (modified by reacting gelatin with a compound having a group capable of reacting with the functional groups contained in the gelatin molecule (i.e., amino groups, imino groups, hydroxy groups or carboxy groups)), or by a graft gelatin prepared by grafting a molecular chain of another high molecular weight substance to the gelatin molecule. Suitable branch high polymers to be grafted on gelatin, are described in U.S. Pat. Nos. 2,763,625, 2,831,767, 2,956,884, *Polymer Letters,* 5, 595 (1967), Phot, Sci. Eng., 9, 148 (1965), *J. Polymer Sci.,* A-1, 9, 3199 (1971), and the like. Homopolymers or copolymers of those monomers which are generally called vinyl monomers, such as acrylic acid, methacrylic acid, the ester, amide, and nitrile derivatives thereof, styrene, etc. can be widely used. However, hydrophilic vinyl polymers having some compatibility with gelatin, such as the homopolymers or copolymers of acrylic acid, acrylamide, methacrylamide, hydroxyalkyl acrylates, hydroxyalkyl methacrylates, etc. are particularly preferred. Also, in the photographic emulsion layers and other layers used in the present invention synthetic polymer compounds such as latex-like vinyl compound polymers dispersed in water, compounds capable of increasing, in particular, the dimensional stability of photographic materials, and the like, can be employed alone or in combination (of different polymers) or in combination with a hydrophilic water-permeable colloid. Suitable polymers, are described in e.g., U.S. Pat. Nos.2,376,005, 2,739,137, 2,853,457, 3,062,674, 3,411,911, 3,488,708, 3,525,620, 3,635,715, 3,607,290, 3,645,740, British Pat. Nos.

1,186,699, 1,307,373, etc. Of these, copolymers or homopolymers of monomers selected from the alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride and itaconic anhydride are generally used. In some cases, a so-called graft-type emulsion polymerization latex prepared by conducting emulsion polymerization in the copresence of a hydrophilic protective colloid high polymer can be used.

The emulsion can be hardened in a conventional manner. Examples of hardeners are, for example, aldehyde compounds such as formaldehyde, glutaraldehyde, etc.; ketone compounds such as diacetyl, cyclopentanedione, etc.; compounds having a reactive halogen such as bis(2-chloroethylurea), 2-hydroxy-4,6-dichloro-1,3,5-triazine and those described in U.S. Pat. Nos. 3,288,775, 2,732,303, British Patent Publication Nos. 974,723, 1,167,207, etc.; reactive olefin compounds such as divinylsulfone, 5-acetyl-1,3-diacryloylhexahydro-1,3,5-triazine, those described in U.S. Pat. Nos.3,635,718, 3,232,763, British Patent Publication No. 994,869, etc.; N-methylol compounds such as N-hydroxylmethylphthalimide and those described in U.S. Pat. Nos. 2,732,316, 2,586,168, etc.; isocyanates as described in U.S. Pat. No. 3,103,437; aziridine compounds as described in U.S. Pat. Nos. 3,017,280, 2,983,611, etc.; acid compounds as described in U.S. Pat. Nos. 2,725,294, 2,725,295, etc.; carbodiimide compounds as described in U.S. Pat. No. 3,100,704, etc.; epoxy compounds as described in U.S. Pat. No.3,091,437, etc.; isoxazole compounds as described in U.S. Pat. Nos. 3,321,313 and 3,543,292; halocarboxyaldehydes such as mucochloric acid, etc.; dioxane compounds such as dihydroxydioxane, dichlorodioxane, etc.; and inorganic hardening agents such as chromium alum, zirconium sulfate, etc. Also, precursors of the above-described compounds such as the alkali metal bisulfite-aldehyde adducts, hydantoin methylol compounds, primary aliphatic nitroalcohols, etc. can be used in place of the above-described compounds.

The photographic emulsion can be coated on a substantially planar substance which does not undergo any serious dimensional change during processing, such as a rigid support (like glass) or a flexible support. Typical flexible supports include a cellulose nitrate film, a cellulose acetate film, a cellulose acetate butyrate film, a cellulose acetate propionate film, a polystyrene film, a polyethylene terephthalate film, a polycarbonate film, a laminate thereof, paper, etc., commonly used for photographic light-sensitive materials. Papers coated or laminated with baryta or an $\alpha$-olefin polymer, in particular, a polymer of an $\alpha$-olefin having 2 to 10 carbon atoms such as polyethylene, polypropylene, ethylene-butadiene copolymers, etc., plastic films whose surface has been roughened to improve the intimate adhesive property with other polymer substances and increase the printing characteristics as described in Japanese Patent Publication No. 19068/72, and the like can provide good results. Of these supports, a transparent or opaque support is selected depending upon the end use of the light-sensitive materials. Also, with transparent supports, not only colorless, transparent supports but transparent supports colored by adding dyes or pigments can be used as well. This coloring of supports has been conducted with X-ray films and is described in *J. SMPTE*, 67, p.296 (1958), etc.

Opaque supports include essentially opaque supports such as paper and, in addition, supports prepared by adding dyes or pigments like titanium oxide to a transparent film, a plastic film having been surface-treated according to the method described in Japanese Patent Publication No. 19068/72, papers or plastic films to which carbon black, a dye or the like has been added to make them completely light-intercepting and the like. Where the adhesion between the support and the photographic emulsion layer is insufficient, a layer adhesive to both the support and the photographic emulsion layer as a subbing layer can be provided. Also, in order to further improve the adhesion, the surface of a synthetic resin can be subjected to preliminary processings such as corona discharge, irradiation with ultraviolet light, flame treatment, etc.

Each layer can be coated using various coating methods including dip-coating, air-knife coating, and extrusion coating using a hopper, for example, as described in U.S. Pat. No. 2,681,294.

If desired, two or more layers can be coated at the same time according to the method described in U.S. Pat. Nos. 2,761,791, 3,508,947, 2,941,898, 3,526,528, etc.

The exposed light-sensitive material of this invention can be color-developed and then bleached and fixed or blixed to form an image.

The light-sensitive material of the present invention can be color development-processed using an aromatic primary amino compound such as a p-phenylenediamine derivative. Typical color developing agents include inorganic acid salts of N,N-diethyl-p-phenylenediamine, 2-amino-5-diethylaminotoluene, 2-amino-5-(N-ethyl-N-laurylamino)toluene, 4-[N-ethyl-N-($\beta$-hydroxyethyl)amino]aniline, 3-methyl-4-amino-N-ethyl-N-($\beta$-hydroxyethyl)amino aniline, etc.; 4-amino-3-methyl-N-ethyl-N-($\beta$-methanesulfonamidoethyl)aniline sesquisulfate monohydrate as described in U.S. Pat. No. 2,193,015; N-(2-amino-5-diethylaminophenylethyl)methanesulfonamide sulfate as described in U.S. Pat. No. 2,592,364; N,N-dimethyl-p-phenylenediamine hydrochloride; 3-methyl-4-amino-N-ethyl-N-methoxy-ethylaniline described in Japanese Patent Laid-Open No. 64933/73; and the like.

These color developing agents are described in detail in e.g., L. F. A. Mason; *Photographic Processing Chemistry*, p. 226–229, Focal Press, London, (1966).

Also, these color developing agents can be used in combination with 3-pyrazolidones.

To the color developing solution can be added, if desired, various additives. Typical examples of suitable additives include an alkali agent (e.g., an alkali metal or ammonium hydroxide, carbonate or phosphate), a pH-adusting or buffering agent (e.g., a weak acid such as acetic acid, boric acid, etc., a weak base, and a salt thereof), a development accelerator (e.g., various pyridinium compounds as described in U.S. Pat. Nos. 2,648,604, 3,671,247, etc., cationic compounds, potassium nitrate, sodium nitrate, polyethylene glycol condensates as described in U.S. Pat. Nos. 2,533,990, 2,577,127, 2,950,970, etc. and the derivatives thereof, nonionic compounds such as polythioethers of which the compounds described in British Pat. Nos. 1,020,033 and 1,020,032 are representative, polymers having a sulfate ester group of which the compounds described in U.S. Pat. No. 3,068,097 are representative, organic amines such as pyridine, ethanolamine, etc., benzyl alcohol, hydrazines, and the like), an anti-fogging agent (e.g., an alkali metal bromide, an alkali metal iodide, nitrobenzimidazole as described in U.S. Pat. Nos. 2,496,940 and 2,656,271, mercaptobenzimidazole, 5-methylbenzotriazole, 1-phenyl-5-mercaptotetrazole, antifoggants for a rapid processing solution as described in U.S. Pat. Nos. 3,113,864, 3,342,596, 3,295,976, 3,615,522, 3,597,199, etc., thiosulfonyl compounds as described in British Pat. No. 972,211, phenazine-N-oxides as described in Japanese Patent Publication No. 41675/71, antifogging agents as described in *Scientific Photographic Handbook*, II, pp. 29–47, etc.), stain- or sludge-preventing agents as described in U.S. Pat. Nos. 3,161,513, 3,161,514, British Pat. Nos. 1,030,442 and 1,144,481, 1,251,558, an interimage effect-accelerating agent as described in U.S. Pat. No. 3,536,487, and a preservative (e.g., a sulfite, a bisulfite, hydroxylamine hydrochloride, formsulfite, an alkanolamine-sulfite adduct, etc.).

To a bleaching bath can be added, if desired, a fixing agent so that the both can be used as a bleach-fixing bath. Many compounds can be used as the bleaching agent. Of these, ferricyanides, dichromate, water-soluble cobalt (III) salts, water-soluble copper (II) salts, water-soluble quinones, nitrosophenols, a complex salt between a multivalent cation such as iron (III), cobalt (III), copper (II), etc. and an organic acid (e.g., a metal salt of ethylenediaminetetraacetic acid, nitrilotriacetic acid, iminodiacetic acid, N-hydroxyethylethylenediaminetriacetic acid or like aminopolycarboxylic acid, malonic acid, tartaric acid, malic acid, diglycolic acid, dithioglycolic acid, 2,6-dipicolinic acid-copper complex salt; etc.), peracids (e.g., alkylperacids, persulfates, permanganates, hydrogen peroxide, etc.), hydrochlorites, chlorine, bromine, and the like are generally used alone or in suitable combination.

The present invention will now be illustrated in greater detail by reference to the following non-limiting example of a preferred embodiment of the invention. Unless otherwise indicated herein, all parts, percents, ratios, and the like are by weight.

EXAMPLE

[Sample A] (Comparative sample corresponding to the stratum structure shown in FIG. 1)

The following emulsion layers were coated, in sequence, on a subbing layer on a support of polyethylene terephthalate.

First Layer (Red-sensitive emulsion layer)

To 1000 g of a highly sensitive silver bromoiodide emulsion (halogen composition: 5 mol% iodide) containing 10 g of silver halide and 5 g of gelatin per 100 g was added 100 cc of a 0.06% methanol solution of Sensitizing Dye S-1. Then, 500 g of a gelatin solution having dissolved therein Cyan Coupler C-1 (silver/coupler ratio=7 mols/1 mol), 50 cc of a 1% aqueous solution of Stabilizer A-1, 50 cc of a 1% aqueous solution of Coating Agent T-1 and 20 cc of a 2% aqueous solution of Hardener H-1 were added thereto. The resulting emulsion solution was coated in a dry thickness of 4μ.

Second Layer (Interlayer)

A gelatin solution, prepared by adding 100 g of a gelatin aqueous solution containing emulsified and dispersed therein Color Stain-Preventing Agent A-2, 50 cc of a 1% aqueous solution of Coating Agent T-1 and 20 cc of a 2% aqueous solution of Hardener H-1 to 1000 g of a 5% gelatin aqueous solution, was coated in a dry thickness of 1μ.

Third Layer (Green-sensitive emulsion layer)

To 1000 g of a highly sensitive silver bromoiodide emulsion (halogen composition: 5 mol% iodide) containing 10 g of silver halide and 5 g of gelatin per 100 g was added 100 cc of a 0.1% methanol solution of Sensitizing Dye S-2. Then, 700 g of a gelatin solution containing emulsified and dispersed therein Magenta Coupler C-2 (silver/coupler ratio=about 7 mols/1 mol), 50 cc of an aqueous solution of Stabilizing Agent A-1, 50 cc of a 1% aqueous solution of Coating Agent T-1 and 20 cc of a 2% aqueous solution of Hardener H-1 were added thereto. The resulting emulsion solution was coated in a dry thickness of 4μ.

Fourth Layer (Yellow filter layer)

To 1000 g of a 5% gelatin aqueous solution containing dispersed therein colloidal silver were added 100 cc of a 1% aqueous solution of Coating Agent T-1 and a 2% aqueous solution of Hardener H-1. The resulting solution was coated in a silver amount of 0.5 mg/100 $cm^2$.

Fifth Layer (Blue-sensitive emulsion layer)

To 1000 g of a highly sensitive silver bromoiodide emulsion (halogen composition: 5 mol% iodide) containing 10 g of silver halide and 5 g of gelatin per 100 g were added 500 g of a gelatin solution containing emulsified and dispersed therein Yellow Coupler C-3 (silver/coupler ratio=about 7 mols/1 mol), 50 cc of a 1% aqueous solution of Stabilizer A-1, 50 cc of a 1% aqueous solution of Coating Agent T-1 and 20 cc of a 2% aqueous solution of Hardener H-1. The resulting emulsion solution was coated in a dry thickness of 4μ.

Sixth Layer (Protective layer)

A gelatin solution, prepared by adding 100 cc of a 1% aqueous solution of Coating Agent T-1 and 20 cc of a 1% aqueous solution of Hardener H-1 to a 5% gelatin aqueous solution, was coated in a dry thickness of 1μ.

[Sample B] (The relative relationship of each layer corresponds to the structure shown in FIG. 2)

The following emulsion solutions were prepared and coated on the same kind of support as described in Sample A.

First Layer (Red-sensitive emulsion layer)

The same coating solution as used for the first layer of Sample A was prepared and coated in the same manner.

Second Layer (1st Interlayer)

The same coating solution as used for the second layer of Sample A was prepared and coated in the same manner.

Third Layer (First green-sensitive emulsion layer)

The same coating solution as used for the third layer of Sample A was prepared and coated in a thickness of 2μ.

Fourth Layer (Yellow filter layer)

The same coating solution as used for the fourth layer of Sample A was prepared and coated in the same manner.

Fifth Layer (Blue-sensitive emulsion layer)

A coating solution as used for Sample A except that the highly sensitive silver bromoiodide emulsion used was more sensitive (1.2 times) than that of Sample A was prepared and coated in the same manner.

Sixth Layer (Second interlayer)

The same coating solution as used for the second layer of Sample A was prepared and coated in the same manner.

Seventh Layer (Second green-sensitive emulsion layer)

A coating solution as used for the third layer of Sample A except that the silver bromoiodide emulsion used had a low sensitivity (1/10 that of the green-sensitive emulsion in sample A) and that 150 cc of 0.1% methanol solution of Sensitizing Dye S-2 was added was prepared and coated in a dry thickness of 2μ.

Eighth Layer (Protective layer)

The same coating solution as used for the sixth layer of Sample A was prepared and coated in the same manner.

[Sample C] (The relative relationship of each layer corresponds to the structure shown in FIG. 4)

The following emulsion solutions were prepared and coated on the same kind of support as described in Sample A.

First Layer (Red-sensitive emulsion layer)

The same coating solution as used for the first layer of Sample A was prepared and coated in the same manner.

Second Layer (First interlayer)

The same coating solution as used for the second layer of Sample A was prepared and coated in the same manner.

Third Layer (First green-sensitive emulsion layer)

The same coating solution as used for the third layer of Sample B was prepared and coated in the same manner.

Fourth Layer (Yellow filter layer)

The same coating solution as used for the fourth layer of Sample A was prepared and coated in a silver amount of 0.4 mg/100 $cm^2$.

Fifth Layer (Blue-sensitive emulsion layer)

A coating solution as used for Sample B except that the highly-sensitive silver bromoiodide emulsion used was more sensitive (1.2 times) than that of Sample B was prepared and coated in the same manner.

Sixth Layer (Second interlayer)

The same coating solution as used for the second layer of Sample A was prepared and coated in the same manner.

Seventh Layer (Second green-sensitive emulsion layer)

A coating solution as used for the seventh layer of Sample B except that the low sensitive silver bromoiodide emulsion used was more sensitive (1.2 times) than that of Sample B was prepared and coated in the same manner.

Eighth Layer (Protective layer)

The same coating solution as used for the fourth layer of Sample A was prepared and coated in a silver amount of 0.1 mg/100 $cm^2$.

[Sample D] (The relative relationship of each layer corresponds to the stratum structure shown in FIG. 3)

The following emulsion solutions were prepared and coated on the same kind of support as described in Sample A.

First Layer (First red-sensitive emulsion layer)

The same coating solution as used for the first layer of Sample A was prepared and coated in a dry thickness of 2μ.

Second Layer (First interlayer)

The same coating solution as used for the second layer of Sample A was prepared and coated in the same manner.

Third Layer (First green-sensitive emulsion layer)

The same coating solution as used for the third layer of Sample B was prepared and coated in the same manner.

Fourth Layer (Yellow filter layer)

The same coating solution as used for the fourth layer of Sample A was prepared and coated in the same manner.

Fifth Layer (Blue-sensitive emulsion layer)

The same coating solution as used for the fifth layer of Sample C was prepared and coated in the same manner.

Sixth Layer (Second interlayer)

The same coating solution as used for the second layer of Sample A was prepared and coated in the same manner.

Seventh Layer (Second red-sensitive emulsion layer)

A coating solution as used for the first layer of Sample A except that the silver bromoiodide emulsion used had a low sensitivity (⅛ that of Sample A) and that 150 cc of a 0.1% methanol solution of Sensitizing Dye S-2 was added was prepared and coated in a dry thickness of 2μ.

Eighth Layer (Third interlayer)

The same coating solution as used for the second layer of Sample A was prepared and coated in the same manner.

Ninth Layer (Second green-sensitive emulsion layer)

The same coating solution as used for the seventh layer of Sample B was prepared and coated in the same manner.

Tenth Layer (Protective layer)

The same coating solution as used for the sixth layer of Sample A was prepared and coated in the same manner.

[Sample E] (The relative relationship of each layer corresponds to the structure shown in FIG. 5)

The following emulsions were prepared and coated on the same kind of support as described in Sample A.

First Layer (First red-sensitive emulsion layer)

The same coating solution as used for the first layer of Sample D was prepared and coated in the same manner.

Second Layer (First interlayer)

The same coating solution as used for the second layer of Sample A was prepared and coated in the same manner.

Third Layer (First green-sensitive emulsion layer)

The same coating solution as used for the third layer of Sample B was prepared and coated in the same manner.

Fourth Layer (Yellow filter layer)

The same coating solution as used for the fourth layer of Sample C was prepared and coated in the same manner.

Fifth Layer (Blue-sensitive emulsion layer)

A coating solution as used for the fifth layer of Sample D except that the highly sensitive silver bromoiodide emulsion used was more sensitive (1.2 times) than that of Sample D, was prepared and coated in the same manner.

Sixth Layer (Second interlayer)

The same coating solution as used for the second layer of Sample A was prepared and coated in the same manner.

Seventh Layer (Second red-sensitive emultion layer)

A coating solution as used for the seventh layer of Sample D except that the low sensitive silver bromoiodide emulsion used was more sensitive (1.2 times) than that of Sample D, was prepared and coated in the same manner.

Eighth Layer (Third interlayer)

The same coating solution as used for the second layer of Sample A was prepared and coated in the same manner.

Ninth Layer (Second green-sensitive emulsion layer)

The same coating solution as used for the seventh layer of Sample C was prepared and coated in the same manner.

Tenth Layer (Protective layer)

The same coating solution as used for the eighth layer of Sample C was prepared and coated in the same manner.

Sensitizing Dye S-1

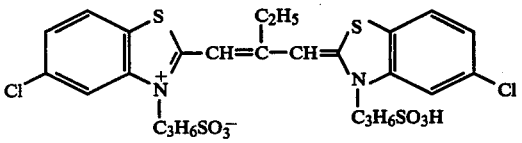

Sensitizing Dye S-2

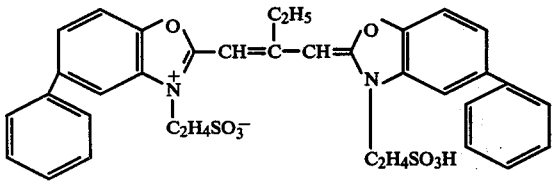

Cyan Coupler C-1

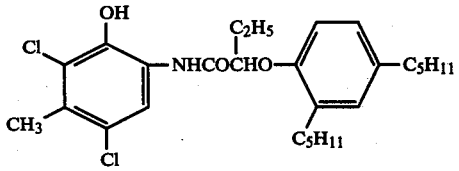

Manner of emulsification: 75 g of Cyan Coupler C-1 was dissolved in a mixture of 100 cc of dibutyl phthalate and 200 cc of ethyl acetate and was emulsified in 600 g of a 10% gelatin aqueous solution together with a dispersing aid.

Magenta Coupler C-2

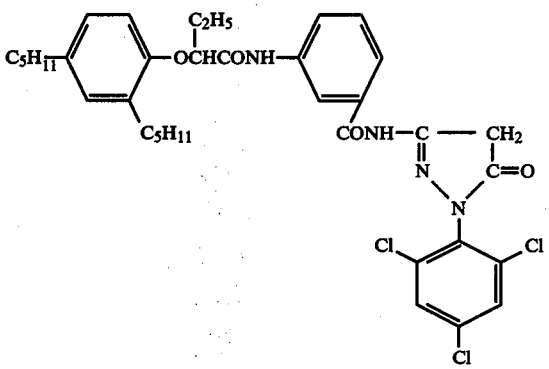

Manner of emulsification: Emulsification was effected in the same manner as with Cyan Coupler C-1 except for dissolving 75 g of Magenta Coupler C-2 in place of Cyan Coupler C-1.

Yellow Coupler C-3

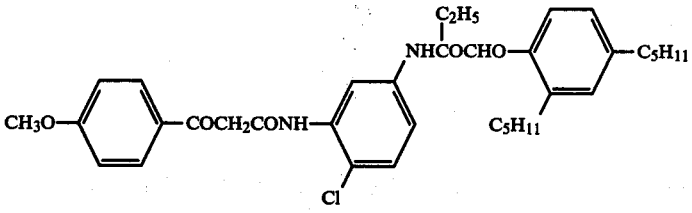

Manner of emulsification: Emulsification was effected in the same manner as with Cyan Coupler C-1 except for dissolving 90 g of Yellow Coupler C-3 in place of Cyan Coupler C-1.

Stabilizer A-1

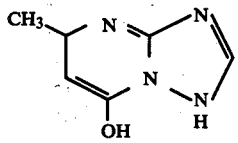

Color Stain Preventing Agent A-2

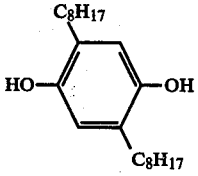

Manner of emulsification: 100 g of Color Stain-Preventing Agent A-2 was dissolved in a mixture of 200 cc of ethyl acetate, and was emulsified in 500 g of a 10% gelatin aqueous solution together with a dispersing aid.

Coating Agent T-1

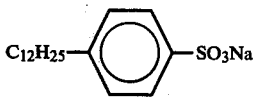

Hardener H-1

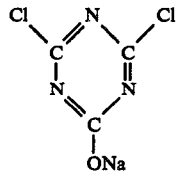

A comparison of the sharpness of Samples A to E was conducted by determining the modulation transfer function (hereinafter abbreviated as MTF) of each sample and comparing the MTF values at a certain frequency. The greater is the MTF value, the higher is the sharpness. Measurement of the MTF value was effected according to M. Takano and I. Fujimura; "Inspection Without Destruction" Scientific Publications of the Fuji Photo Film Co., Ltd., No. 15, p.35–47 (1967).

Also, a comparison of graininess was conducted by determining the Root Mean Square (hereinafter abbreviated as RMS) at microscopic density and comparing the RMS value at a density of 1.0 with that at a density of 1.5. The smaller is the RMS value, the better is the graininess. The RMS values were measured according to the description in M. Takano; *Television,* vol. 23, No. 1, pp.13–23 (1969).

The development was conducted according to the following sequence of steps.

| Processing Step | Temp. | Time |
|---|---|---|
| Hardening | 30° C. | 1 min. |
| Washing | " | 1 |
| First Development | " | 3 |
| Washing | " | 0.5 |
| Reversal Exposure | (uniform exposure of emulsion surface in an exposure amount of 8,000 1x) | |
| Second Development | 30° C. | 4 |
| Washing | " | 1 |
| Bleaching | " | 1 |
| Washing | " | 0.5 |
| Fixing | 30° C. | 1 min. |
| Washing | " | 1 |

The processing solutions used had the following compositions.

| Hardening Bath | |
|---|---|
| Sulfuric Acid (1:1 by volume with water) | 5.4 ml |
| Sodium Sulfate | 150 g |
| Sodium Acetate | 20 g |
| Formaldehyde (40% aqueous solution) | 10 ml |
| Pyruvic Aldehyde (40% aqueous solution) | 10 ml |
| Water to make the total | 1 liter |
| First Developer | |
| 4-(N-Methylamino)phenol Sulfate | 2 g |
| Sodium Sulfate | 90 g |
| Hydroquinone | 8 g |
| Sodium Carbonate (monohydrate) | 52.5 g |

-continued

| Hardening Bath | |
|---|---|
| Potassium Bromide | 5 g |
| Potassium Thiocyanate | 1 g |
| Water to make the total | 1 liter |
| Second Developer | |
| Benzyl Alcohol | 5 ml |
| Sodium Sulfite | 5 g |
| Hydroxylamine Hydrochloride | 2 g |
| 4-Amino-3-methyl-N-ethyl-N-(β-methanesulfonamido)ethylaniline Sesquisulfate Monohydrate | 1.5 g |
| Potassium Bromide | 1 g |
| Sodium Tertiary Phosphate | 30 g |
| Sodium Hydroxide | 0.5 g |
| Ethylenediamine (70% aqueous solution) | 7 ml |
| Water to make the total | 1 liter |
| Bleaching Solution | |
| Potassium Ferricyamide | 100 g |
| Sodium Acetate | 40 g |
| Glacial Acetic Acid | 20 ml |
| Potassium Bromide | 30 g |
| Water to make the total | 1 liter |
| Fixing Solution | |
| Sodium Thiosulfate | 150 g |
| Sodium Acetate | 70 g |
| Sodium Sulfite | 10 g |
| Potassium Alum | 20 g |
| Water to make the total | 1 liter |

The MFT and RMS values obtained with Samples A to E according to the above-described procedures are shown in Table 1 below.

Table 1

| Sample | Specific Sensitivity RL | GL | BL | MTF (%) RL 30 Lines | RL 60 Lines | GL 30 Lines | GL 60 Lines | RMS Value RL Density 1.0 | RL Density 1.5 | GL Density 1.0 | GL Density 1.5 |
|---|---|---|---|---|---|---|---|---|---|---|---|
| A** | 100* | 100* | 100* | 20 | 5 | 25 | 13 | 0.065 | 0.089 | 0.048 | 0.069 |
| B | 95 | 100 | 105 | 19 | 6 | 37 | 20 | 0.064 | 0.090 | 0.039 | 0.055 |
| C | 100 | 95 | 100 | 21 | 4 | 36 | 19 | 0.066 | 0.089 | 0.042 | 0.061 |
| D | 105 | 95 | 100 | 31 | 16 | 37 | 21 | 0.055 | 0.072 | 0.040 | 0.054 |
| E | 100 | 100 | 95 | 32 | 15 | 35 | 20 | 0.058 | 0.079 | 0.043 | 0.060 |

*Standard
**Conventional stratum structure

As is clear from the results in Table 1, the sharpness and graininess of the GL of Samples B and C and both the GL and the RL of Samples D and E were markedly improved as compared with Sample A.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material, which comprises a support having thereon at least a red-sensitive silver halide emulsion layer, two green-sensitive silver halide emulsion layers, a yellow filter layer and a blue-sensitive silver halide layer, in which the two green-sensitive layers comprise a first green-sensitive silver halide emulsion layer and a second green-sensitive silver halide emulsion layer and the relative positionwise relationship of each layer is in the order of the red-sensitive silver halide emulsion layer, the first green-sensitive silver halide emulsion layer, the yellow filter layer, the blue-sensitive silver halide emulsion layer and the second green-sensitive silver halide emulsion layer from the support.

2. A color photographic light-sensitive material, which comprises a support having thereon at least a red-sensitive silver halide emulsion layer, two green-sensitive silver halide emulsion layers, a yellow filter layer, a blue-sensitive silver halide emulsion layer and a protective layer, in which the two green-sensitive silver halide emulsion layers comprise a first green-sensitive silver halide emulsion layer and a second green-sensitive silver halide emulsion layer and the relative positionwise relationship of each layer is in the order of the red-sensitive silver halide emulsion layer, the first green-sensitive silver halide emulsion layer, the yellow filter layer, the blue-sensitive silver halide emulsion layer, the second green-sensitive silver halide emulsion layer and the protective layer from the support and in which the yellow filter density is provided by the yellow filter layer and the protective layer with not more than about 50% of the total yellow density being provided by the protective layer.

3. A color photographic light-sensitive material, which comprises a support having thereon at least two red-sensitive silver halide emulsion layers, two green-sensitive silver halide emulsion layers, a yellow filter layer and a blue-sensitive silver halide emulsion layer, with the two red-sensitive silver halide emulsion layers comprising a first red-sensitive silver halide emulsion layer and a second red-sensitive silver halide emulsion layer and the two green-sensitive silver halide emulsion layers comprising a first green-sensitive silver halide emulsion layer and a second green-sensitive silver halide emulsion layer and the relative positionwise relationship of each layer is in the order of the first red-sensitive silver halide emulsion layer, the first green-sensitive silver halide emulsion layer, the yellow filter layer, the blue-sensitive silver halide emulsion layer, the second red-sensitive silver halide emulsion layer and the second green-sensitive silver halide emulsion layer from the support.

4. A color photographic light-sensitive material which comprises a support having thereon at least two red-sensitive silver halide emulsion layers, two green-sensitive silver halide emulsion layers, a yellow filter, a blue-sensitive silver halide emulsion layer and a protective layer, with the two red-sensitive silver halide emulsion layers comprising a first red-sensitive silver halide emulsion layer and a second red-sensitive silver halide emulsion layer and the two green-sensitive silver halide emulsion layers comprising a first green-sensitive silver halide emulsion layer and a second green-sensitive silver halide emulsion layer and the relative positionwise relationship of each layer is in the order of the first red-sensitive silver halide emulsion layer, the first green-sensitive silver halide emulsion layer, the yellow filter layer, the blue-sensitive silver halide emulsion layer, the second red-sensitive silver halide emulsion layer, the second green-sensitive silver halide emulsion layer, and the protective layer from the support, and in which the yellow filter desnity is provided by the yellow filter layer and the protective layer with not more than about 50% of the total yellow density being provided by the protective layer.

5. The color photographic light-sensitive material of claim 1, wherein said second green-sensitive silver halide emulsion layer has a sensitivity lower than the sensitivity of said first green-sensitive silver halide emulsion layer.

6. The color photographic light-sensitive material of claim 2, wherein said second green-sensitive silver halide emulsion layer has a sensitivity lower than the sensitivity of said first green-sensitive silver halide emulsion layer.

7. The color photographic light-sensitive material of claim 3, wherein said second green-sensitive silver halide emulsion layer has a sensitivity lower than the sensitivity of said first green-sensitive silver halide emulsion layer.

8. The color photographic light-sensitive material of claim 4, wherein said second green-sensitive silver halide emulsion layer has a sensitivity lower than the sensitivity of said first green-sensitive silver halide emulsion layer.

9. The color photographic light-sensitive material of claim 5, wherein the sensitivity of said second green-sensitive silver halide emulsion layer is about 0.1 to 0.2 times the sensitivity of said first green-sensitive silver halide emulsion layer.

10. The color photographic light-sensitive material of claim 6, wherein the sensitivity of said second green-sensitive silver halide emulsion layer is about 0.1 to 0.2 times the sensitivity of said first green-sensitive silver halide emulsion layer.

11. The color photographic light-sensitive material of claim 7, wherein the sensitivity of said second green-sensitive silver halide emulsion layer is about 0.1 to 0.2 times the sensitivity of said first green-sensitive silver halide emulsion layer.

12. The color photographic light-sensitive material of claim 8, wherein the sensitivity of said second green-sensitive silver halide emulsion layer is about 0.1 to 0.2 times the sensitivity of said first green-sensitive silver halide emulsion layer.

13. The color photographic light-sensitive material of claim 1, wherein said second green-sensitive silver halide emulsion layer provides about $\frac{1}{4}$ to $\frac{3}{4}$ of the total magenta dye density obtained on color development of said light-sensitive material.

14. The color photographic light-sensitive material of claim 2, wherein said second green-sensitive silver halide emulsion layer provides about $\frac{1}{4}$ to $\frac{3}{4}$ of the total magenta dye density obtained on color development of said light-sensitive material.

15. The color photographic light-sensitive material of claim 3, wherein said second green-sensitive silver halide emulsion layer provides about $\frac{1}{4}$ to $\frac{3}{4}$ of the total magenta dye density obtained on color development of said light-sensitive material.

16. The color photographic light-sensitive material of claim 4, wherein said second green-sensitive silver halide emulsion layer provides about $\frac{1}{4}$ to $\frac{3}{4}$ of the total magenta dye density obtained on color development of said light-sensitive material.

17. The color photographic light-sensitive material of claim 3, wherein said second red-sensitive silver halide emulsion layer provides about $\frac{1}{4}$ to $\frac{3}{4}$ of the total cyan dye density formed upon development of said light-sensitive material.

18. The color photographic light-sensitive material of claim 4, wherein said second red-sensitive silver halide emulsion layer provides about $\frac{1}{4}$ to $\frac{3}{4}$ of the total cyan dye density formed upon development of said light-sensitive material.

* * * * *